US006111972A

United States Patent [19]

Rigondeau

[11] Patent Number: 6,111,972

[45] Date of Patent: Aug. 29, 2000

[54] DIFFUSING VOLUME ELECTROACOUSTIC TRANSDUCER

[75] Inventor: Robert Rigondeau, Saint-Gaudens, France

[73] Assignee: Jean Marie Bernard Paul Verdier, Puteaux, France

[21] Appl. No.: 08/966,563

[22] Filed: Nov. 10, 1997

Related U.S. Application Data

[63] Continuation-in-part of application No. 08/403,855, filed as application No. PCT/FR93/00958, Sep. 28, 1993.

[30] Foreign Application Priority Data

Sep. 28, 1992 [FR] France ..... 92 11636
Sep. 24, 1993 [FR] France ..... 93 11701

[51] Int. Cl.[7] ..... H04R 1/00; H04R 9/06; H04R 11/02

[52] U.S. Cl. ..... 381/431; 381/396; 381/409; 381/412

[58] Field of Search ..... 381/187, 188, 381/194, 199, 205, 200, 201, 203, 204, 184, 374, 185, 386, 396, 401, 409, 412, 421, 423, 431

[56] References Cited

U.S. PATENT DOCUMENTS

| | | | |
|---|---|---|---|
| 3,553,392 | 1/1971 | Liebscher | 179/115.5 |
| 3,684,052 | 8/1972 | Sotome | 181/32 R |
| 3,983,337 | 9/1976 | Babb . | |
| 4,115,667 | 9/1978 | Babb | 179/115.5 VC |
| 4,188,711 | 2/1980 | Babb . | |
| 4,225,756 | 9/1980 | Babb . | |
| 4,239,090 | 12/1980 | Dahlquist . | |
| 4,273,968 | 6/1981 | Suyama | 179/180 |
| 4,384,174 | 5/1983 | Suzuki et al. | 181/174 |
| 4,783,824 | 11/1988 | Kobayashi | 381/201 |
| 4,823,391 | 4/1989 | Schwartz | 381/103 |
| 4,860,370 | 8/1989 | Grosbard | 381/197 |
| 5,425,107 | 6/1995 | Bertagni et al. | 381/202 |
| 5,539,835 | 7/1996 | Bertagni et al. | 381/202 |
| 5,586,195 | 12/1996 | Ishigaki et al. | 381/188 |

FOREIGN PATENT DOCUMENTS

| | | | |
|---|---|---|---|
| 2362549 | 8/1976 | France . | |
| 2474266 | 1/1980 | France . | |
| 2559332 | 8/1985 | France . | |
| 3830461 | 3/1990 | Germany . | |
| 0139184 | 6/1986 | Japan | 381/203 |
| 2062408 | 10/1980 | United Kingdom . | |

OTHER PUBLICATIONS

Patent Abstracts of Japan, vol. 13, No. 103, (E–725), Mar. 10, 1989.
French Search Report (Two).
International Preliminary Examination Report.

*Primary Examiner*—Curtis A. Kuntz
*Assistant Examiner*—Rexford N Barnie
*Attorney, Agent, or Firm*—Harrison & Egbert

[57] ABSTRACT

An electroacoustic transducer includes a low density diffusing volume which supports on its periphery at least one electrically conductive circuit through which an electric signal representative of the signal to be emitted passes. Magnets are mechanically connected to the diffusing volume's periphery. The magnets provide a magnetic field whose field lines surround the conductive circuits which is positioned on the diffusing volume's periphery. Several embodiments are presented, as well as several modes of electrical connections between the circuit emitting the electrical signals and the conductive circuits.

16 Claims, 5 Drawing Sheets

DIFFUSING VOLUME ELECTROACOUSTIC TRANSDUCER

This application is a continuation of application Ser. No. 08/403,855, filed May 30, 1995, now abandoned, which is the National Stage of International Application No. PCT/FR93/00958, filed Sep. 28, 1993.

BACKGROUND OF THE INVENTION

1. Field of the Invention

The present invention relates to an electroacoustic transducer having a diffusing volume.

2. Discussion of Background

Presently known loudspeakers have a generally conical acoustic membrane driven in axial movements by an electromagnet positioned between conductive coils through which the audio signal passes. Because of this membrane, they have a very substantial directivity and a limited operational range of wavelengths. It is thus necessary to place two or three of these loudspeakers in an enclosure to cover the entire range of sensitivity of the human ear, from 20 hertz to 20 kilohertz.

But, even by placing three loudspeakers, the directivity is not improved. Furthermore, research intended to increase the efficiency of these loudspeakers involve a dense magnetic flux and a narrow air gap but this also involves an elevated back-electromotive force. The relative movement of the electromagnets with respect to the conductive coils is thus always symmetrical, because of the return force, i.e., that these loudspeakers have a resonance frequency.

SUMMARY OF THE INVENTION

The present invention intends to overcome these disadvantages by providing an apparatus whose movable portions are constituted by a diffusing volume over which vibrations of very limited amplitude travel. The diffusing volume comprises one element whose thickness is relatively close to that of the other dimensions, width and length, opposite to a membrane whose thickness is very much less than a tenth of the other dimensions. In this way, the most varied forms of audio signals can be rendered by propagation in the diffusing volume and by diffusion in the air at its surface. The waves propagating in the volume do so in multiple directions thus giving the apparatus a very low directivity. Finally, the return force, or back-electromotive force is, by virtue of this propagation in the volume, very low.

An electro-acoustic transducer capable of being compared to a motor having a back-electromotive force and to an impedance comprising a resistive component, a capacitive component and an inductive component, the present invention thus simultaneously:

minimizes the back-electromotive force by the choice of a magnetic flux that is low, but is exerted over a large surface area and by a very open air gap, by accepting a loss in efficiency.

minimizes the capacitive effect that the conventional suspension represents by utilizing a magnetic equilibration effect.

utilizes a volume propagation effect by the use of a very thick diffusing element such that the input in vibration conditions is delayed.

minimizes the inductive effect of the conventional conductor by reducing the number of turns of the conductor forming the coils.

The impedance can then be limited to its resistive portion and thus not cause any disturbance of the electric signals which go through it.

The apparatus which is the object of the present invention is thus an electroacoustic transducer characterized in that it comprises, on the one hand, a low density diffusing volume 8 supporting on its periphery at least one electrically conductive circuit 6, 7, 12, 13, 20, 21 and 22, through which an electric signal representative of the audible signal to be emitted passes and which has been mechanically connected to said periphery and, on the other hand, magnets 2, 3, 4, 5, 14, 15, 16, 17, 18, 19, 23 and 24, providing a magnetic field whose field lines surround at least the conductive circuit positioned on said periphery.

BRIEF DESCRIPTION OF THE DRAWINGS

The description which will follow, made with respect to the annexed drawings with the aim of explaining and in no way limiting makes it possible to better understand the advantages, aims, and characteristics of the invention, in which.

DETAILED DESCRIPTION

Figure 1:
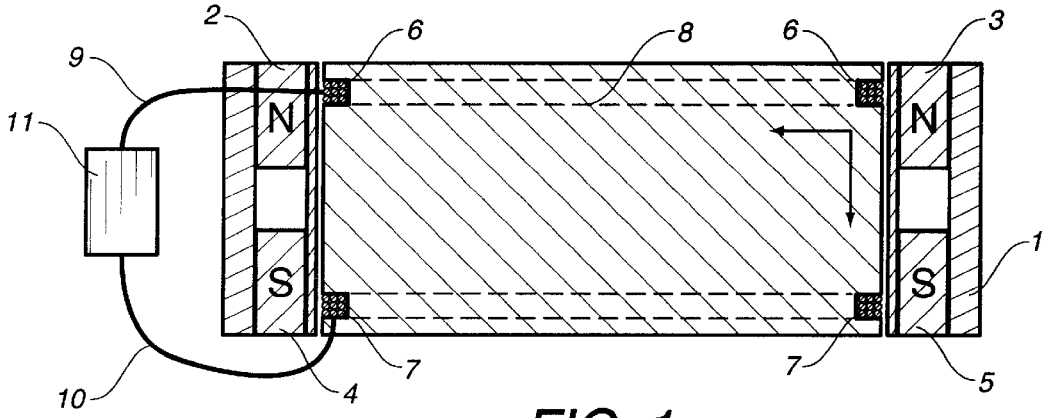
FIG. 1 shows, according to a cross sectional view, a first embodiment of the apparatus according to the present invention.

In FIG. 1 are shown a support 1, four magnets 2, 3, 4, and 5, two conducting circuits 6 and 7, a diffusing volume 8, electrical connections 9 and 10 and an electronic circuit 11.

The support 1 is one of any type and is adapted to maintain in position the four magnets 2, 3, 4, and 5. It is constituted out of soft iron. The magnets 2 and 3 have their north poles towards one another and are positioned at the top of the apparatus. The magnets 4 and 5 have their south poles facing one another and are situated at the bottom of the apparatus. In this manner, the magnetic field between magnets 2, 3, 4 and 5 has annular field lines.

The diffusing volume 8 is located between the magnets 2, 3, 4, and 5. It is constituted out of an approximately rigid material with a very low density, preferably less than 0.2 kilograms per liter, its mass being preferably greater than 20 grams. It supports the conductive circuits 6 and 7. The diffusing volume 8 is constituted for example of expanded polystyrene or polyurethane foam, or of any other material having a very low density and an elevated rigidity. In the example of FIG. 1, the diffusing volume 8 has a rectangular parallelepipedic shape. More generally, a volume is any form whose thickness is greater than 5 millimeters.

The conductive circuits 6 and 7 are electrical conductors and are positioned respectively, facing magnets 2 and 3, on the one hand, and magnets 4 and 5 on the other hand. The conductive circuit 6 extends along the upper periphery of the diffusing volume 8. The conductive circuit 7 extends along the lower periphery of the diffusing volume 8. The conductive circuits of current 6 and 7 are mechanically connected to the diffusing volume 8 and constituted, for example, of thin conductive lines, parallel to one another and having a length equal to that of the permanent magnets formed by printing of conductive ink or silver glue on a support of flexible film, conductive paint, or further by screen printing on plastic film, of the type which is utilized for making certain flexible connectors.

Figure 2:
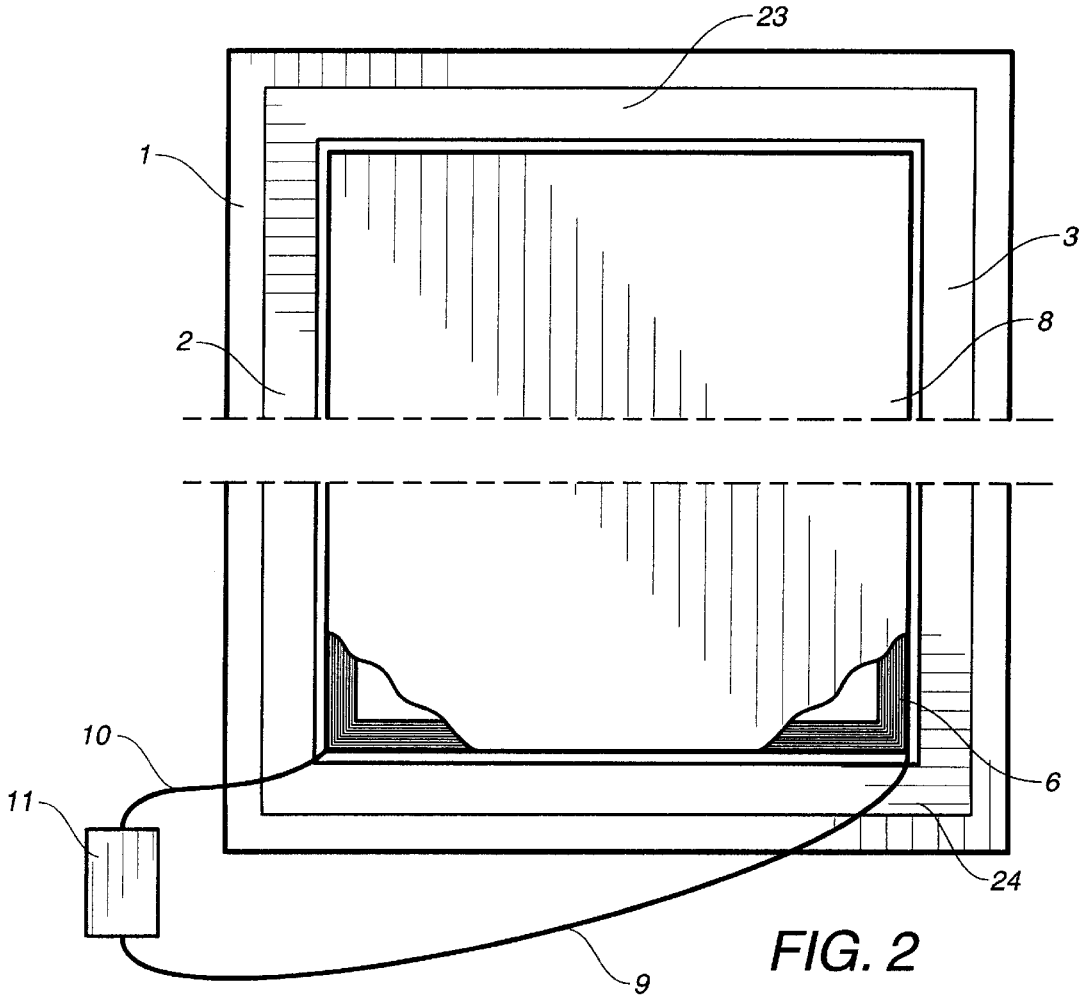
FIG. 2 shows, according to a top view, the first embodiment of the invention described in FIG. 1.
Figure 3:
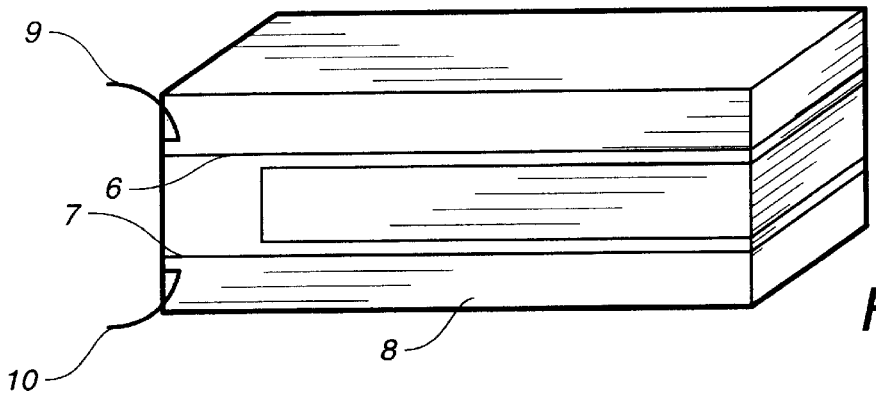
FIG. 3 shows, according to a perspective view, the first embodiment of the apparatus described in FIG. 1.

The conductive circuits 6 and 7 are traversed by an electric signal which is representative of the audible signal to be emitted, but respectively in the opposite direction, as is described in FIGS. 2 and 3.

In this way a Laplace transform which is exerted on the right portion of the conductive circuit 6 has the same axial component, on the vertical axis of symmetry the figure, as the Laplace transform which is exerted on the right portion of the conductive circuit 7 and a planar component, on the plane separating the upper magnets 2 and 3, on the one hand, and the lower permanent magnets 4 and 5 on the other hand, of the same intensity and of the same direction but in the direction opposite the Laplace force which is exerted on the right portion of the conductive circuit 7. It will be remembered that the Laplace equation describes the force, referred to as the Laplace transform, which is exerted on an electrical conductor through which a current runs and which is immersed in a magnetic field.

The electrical connections 9 and 10 connect the electronic circuit 11 emitting an electric signal representative of the sound signal to the conductive circuits 6 and 7. In this first example, the electric connections 9 and 10 connect the ends of the conductive circuits 6 and 7, which are connected to one another in such a way that the current circulates over the periphery of the diffusing volume 8 in the opposite direction. This arrangement is shown in FIG. 3.

According to an alternative of this first embodiment of the present invention, the electrical connections 9 and 10 make it possible to connect each of the two conductors circuits 6 and 7 to a fixed potential and their common terminal to a variable potential comprising a continuous component equal to half of the two fixed potentials and an alternating component proportional to the audible signal to be emitted.

The electric circuit 11 is of a known type, for example constituted by an amplifier which amplifies an audible signal coming from any type of audio source, disc player, cassette player, radio, for example.

In FIG. 2 are shown a top view of support 1, magnets 2 and 3, permanent magnets 23 and 24, conductive circuits 6, the diffusing volume 8, the electrical connections 9 and 10 and the electronic circuit 11.

Support 1 is of rectangular shape and surrounds the other components of the apparatus with the exception of the electronic circuit 11. The magnets 2 and 3 are completed by permanent magnets 23 and 24 to surround the periphery of the diffusing volume 8, itself rectangular. The permanent magnets 23 and 24 have, in the same manner as magnets 2 and 3, their north poles towards the diffusing volume 8.

The conductive circuit 6 surrounds the rectangular periphery of the diffusing volume 8 and is connected to the electric connection 9.

In FIG. 3 are shown a perspective view of the conductive circuits 6 and 7, diffusing volume 8 and the electrical connections 9 and 10.

It will be noted in FIG. 3 that the conductive circuits 6 and 7 are coaxial with respect to the vertical axis which is also the axis of symmetry of the magnetic field. The conductive circuits 6 and 7, are, furthermore, connected to one another in the manner such that the electric current circulates in the conductive circuit 6 in a direction opposite the current circulating in the conductive circuit 7, one circulating in the winding in the clockwise direction and the other in the counterclockwise direction, seen from above.

For the representation of these three FIGS. 1, 2, and 3, the electro-dynamic system having a permanent magnet has been retained. The magnetic field in the air gap has been increased by countersinking of permanent magnets in a "U" shape made out of soft iron constituting the support 1, the magnetic material constituting the magnets 2, 3, 4, and 5 being, for example, bars of iron oxide and strontium having oriented grains. To indicate an example of geometry of the apparatus which is the object of the present invention, the diffusing volume 8 has the following dimensions: 120 millimeters of length, 60 millimeters of width, 30 millimeters of thickness, the area of the magnetic field can be 25 millimeters multiplied by the perimeter of the diffusing volume 8 facing the permanent magnets, the width of conduction thus being 17 millimeters and the displacement of the assembly of the diffusing volume 8 reaching eight millimeters between peaks at very low frequencies.

The aerial magnetic field, being traversed by an identical electrical current circulating along two opposite directions in front of each of the poles, generates opposite forces allowing for an automatic centering of the diffusing volume 8.

The apparatus which is the object of the present invention shown in FIGS. 1–3 also comprises a thick membrane constituting a diffusing volume 8 which assures the emission of sound on the one hand by propagation of elevated frequencies across the membrane, and on the other hand, by propagation of low frequencies in vibration conditions. In the first mode of emission of sound, by propagation within the diffusing volume 8, the center of gravity of diffusing volume 8 is substantially fixed in space. In the second mode of emission of the sound, in vibration conditions the center of gravity of the diffusing volume 8 is displayed substantially at the frequency of the electric signal coming from the electronic circuit 11.

The two conductive circuits 6 and 7 which encompass said diffusing volume in a solid manner, and the magnetic block constituting permanent magnets 2, 3, 4 and 5 creating on the conductive circuits two opposing magnetic fields, form with said conductive circuits a self-centering magnetic motor.

Figure 4:
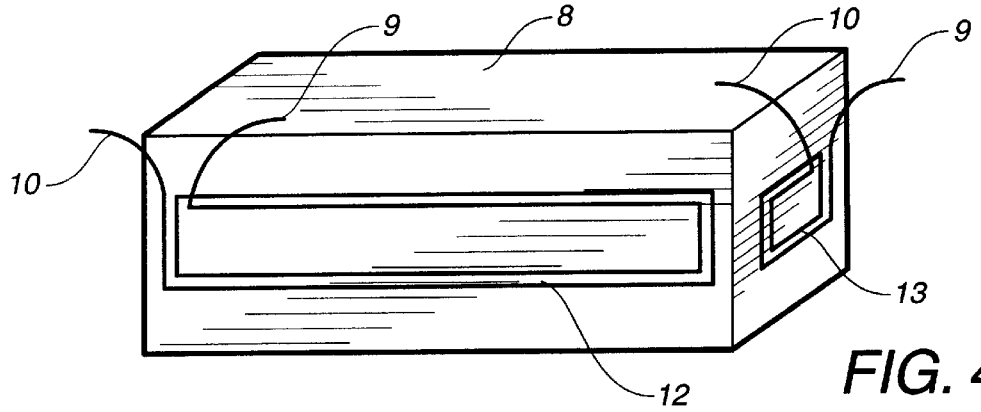
FIG. 4 shows, according to a perspective view, a second embodiment of the apparatus according to the present invention.

In FIG. 4 is shown in perspective view a second embodiment of the apparatus which is the object of the present invention, comprising the diffusing volume 8, the electrical connections 9 and 10 and conductive circuits 12 and 13 each positioned separately on one of the lateral surfaces of diffusing volume 8. It should be noted that two other conductive circuits are positioned on the two peripheral surfaces of the diffusing volume 8 not shown.

The conductive circuits 12 and 13 are each situated integrally on one of the peripheral surfaces of the diffusing volume 8 and represent rectangular coils. The current conducting circuits 12 and 13 are adhered on the diffusing volume 8 and constituted, for example, by a printed circuit of low mass obtained on a support made of epoxy of several tenths of a millimeter whose design is constituted by fine lines parallel to one another and having a length equal to that of the permanent magnets. The current conducting circuits 12 and 13 can also be obtained by printing of conductive ink or silver glue on a support made of a flexible film screen printing, or further by on plastic film, of the type utilized for forming certain flexible connectors. The conductive circuits 12 and 13 are fed electrically such that the electric current circulating in their lower conductors positioned in the vicinity of magnets 4 and 5 circulates in the direction opposite to the electric current circulating in their upper conductors. The Laplace forces shown in FIG. 1 are thus preserved.

The qualities of this second embodiment of the apparatus are identical to the qualities of the first embodiment of the apparatus shown in FIGS. 1–3.

Figure 5:
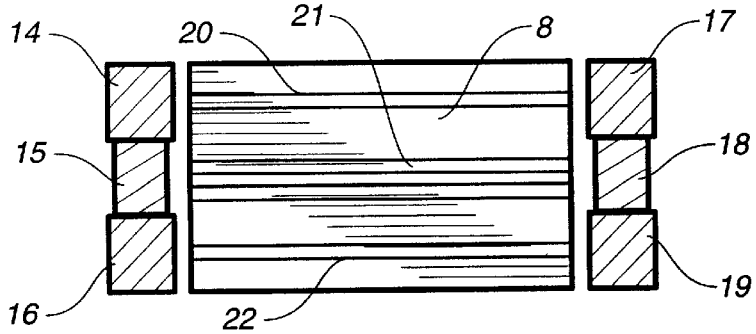
FIG. 5 shows, according to a cross sectional view, a third embodiment of the apparatus according to the present invention.

In FIG. 5 are shown six permanent magnets 14, 15, 16, 17, 18 and 19, three conductive circuits 20, 21, and 22 and the volume 8. This FIG. 5 is adapted to show that the numbers and shapes of the magnets and of the conductive circuits are not limited to two but can on the contrary be varied. The permanent magnets 14, 15, and 16 are situated on the left of the diffusing volume 8. The permanent magnets 17, 18 and 19 are positioned on the right of the diffusing volume 8. The permanent magnets 14, 16, 17 and 19 have their north pole towards the interior of the apparatus i.e., towards the diffusing volume 8. The permanent magnets 15 and 18 have their south pole towards the diffusing volume 8. The conductive circuits 20, 21 and 22 are run through by identical currents but the conductive circuit 21 is run through by this current in the direction opposite the conductive circuits 20 and 22, on the periphery of diffusing volume 8.

This third embodiment of the apparatus has qualities identical to those of the first two embodiments shown in FIGS. 1–3 and in FIG. 4.

Figure 6:
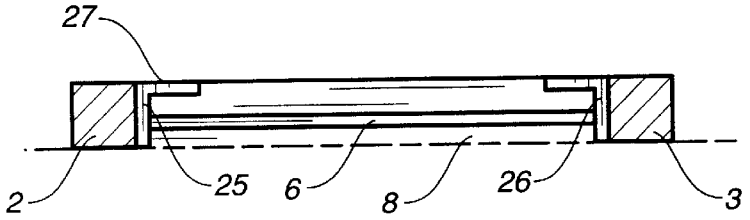
FIG. 6 shows, according to a cross section, a complimentary element of the three embodiments of the apparatus shown in FIGS. 1–5.

In FIG. 6 are shown the permanent magnets 2 and 3, the diffusing volume 8, the conductive circuit 6, a support membrane 27 and two bores 25 and 26.

FIG. 6 is adapted to show, in the example of the first embodiment shown in FIGS. 1–3, the use of a support membrane. This use can very easily be adapted to other embodiments of the apparatus which is the object of the present invention.

The support membrane 27 is constituted of an elastic film, for example made out of polyethylene, whose tension is preferably zero at rest. The bores 25 and 26 follow the periphery of the diffusing volume 8 and make possible, for a given extension the membrane 27, a greater displacement of the diffusing volume 8, than if they were absent.

The support membrane 27 assures the maintenance of the diffusing volume 8 in position between the permanent magnets 2, 3, 4 and 5, even when an impulse of low frequency is emitted by the electronic circuit 11.

The diffusing volume 8 is connected to the support 1 by membrane 27 which also assures the sealing between the two surfaces.

Figure 7:
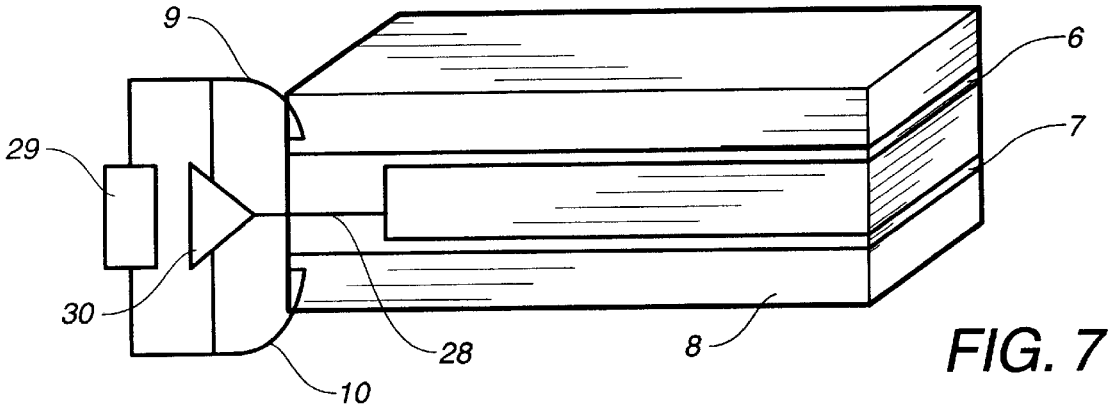
FIG. 7 shows a first mode of electrical connection of the apparatus which is the object of the present invention to an analog electronic circuit.

In FIG. 7 is shown one mode of electrical connection of the apparatus forming the object of the present invention to an electronic circuit. In FIG. 7 are shown the diffusing volume 8, the conductive circuits 6 and 7, the electric connections 9 and 10, an electric connection 28, an electric feed 29 and amplifier circuit 30.

The electric connection 28 connects the output of amplifier circuit 30 to a common terminal of the two conductive circuits 6 and 7. The electric feed 29 is adapted to provide two constant potentials which are connected on the one hand to the terminals of the amplifier circuit 30, and on the other hand, to the terminals of the conductive circuits 6 and 7 respectively connected to the electrical connections 9 and 10. In this manner, in the absence of the electric signal representative of the audible signal to be emitted, the electrical connection 28 is brought to a potential equal to half of the potentials provided by the electrical feed 29, and the electric signal representative of the audible signal to be emitted causes this potential to vary and allows for the generation of Laplace forces on the conductive circuits 6 and 7.

Thus the conductive circuits are each connected on the one hand to a fixed electrical potential, and on the other hand, to a signal comprising a continuous component equal to half of said fixed electrical potentials and an alternating component equal to the electric signal which is representative of the audible signal to be emitted.

The diffusing volume 8 is thus balanced, or sustained, by the continuous component and unbalanced, i.e., set into piston movement by the alternating component.

Figure 8:
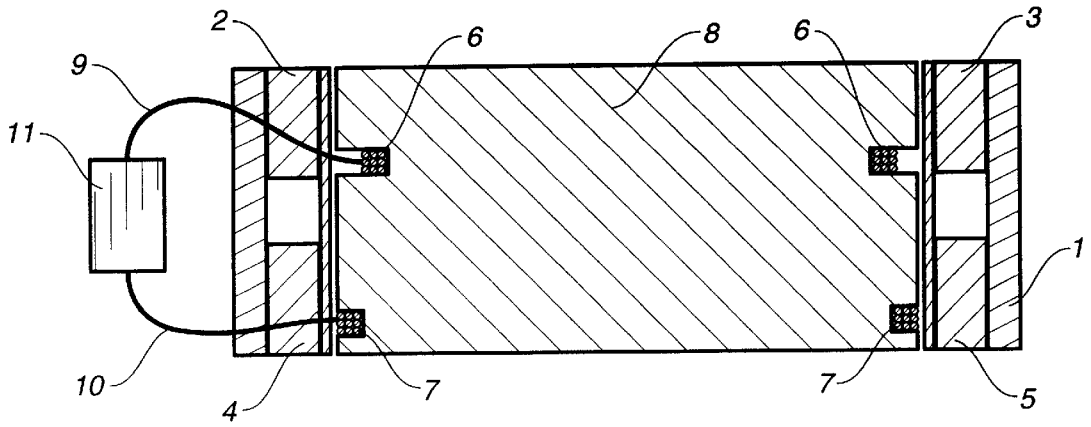
FIG. 8 shows a first variation of the first embodiment of the apparatus shown in FIGS. 1–3.

In FIG. 8 is shown a first variation of the first embodiment of the apparatus shown in FIGS. 1–3.

In FIG. 8 are shown the same elements as in FIG. 1 but the conductive circuits 6 and 7 are asymmetrical between one another. The circuit 6 is spaced further away from the magnets 2 and 3 than the circuit 7 is spaced from the magnets 4 and 5. Circuit 6 is placed on the diffusing volume 8 closer to the median plane of the diffusing volume 8 parallel to the circuits 6 and 7 than the circuit 6. Finally circuit 6 comprises fewer turns of wire forming the coil than circuit 7.

Figure 9:
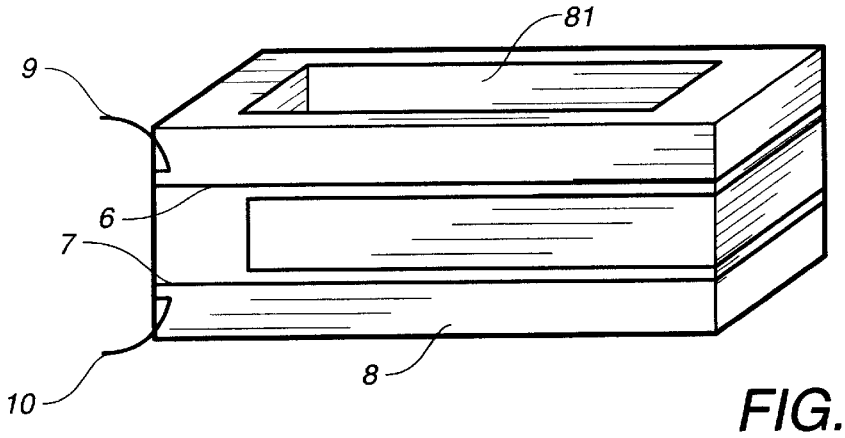
FIG. 9 shows a second variation of the first embodiment of the apparatus shown in FIGS. 1–3.

In FIG. 9 is shown a second variation of the first embodiment of the apparatus shown FIGS. 1–3.

In FIG. 9 are shown the same elements as in FIG. 3, with the exception of the diffusing volume 8 which here assumes the form of a parallelepipedic rectangle recessed on one of its surfaces by a recess 81 of volume equal to a second parallelepipedic rectangle of smaller dimensions than the first.

Figure 10:
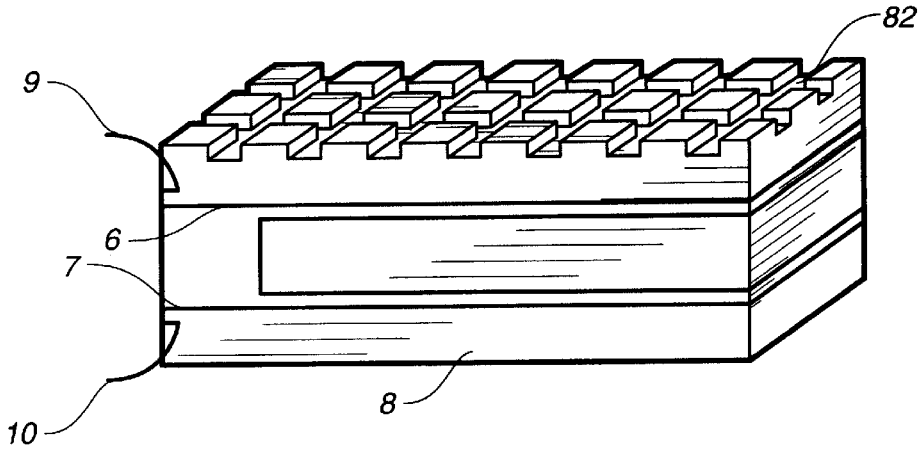
FIG. 10 shows a third variation of the first embodiment of the apparatus shown in FIGS. 1–3.

In FIG. 10 is shown a third variation of the first embodiment of the apparatus shown in FIGS. 1–3.

In FIG. 10 are shown the same elements as in FIG. 3, with the exception of the diffusing volume 8 which here is in the form of a parallelepipedic rectangle recessed on one of its surfaces with grooves 82 forming two networks having straight lines that are perpendicular between them.

Figure 11:
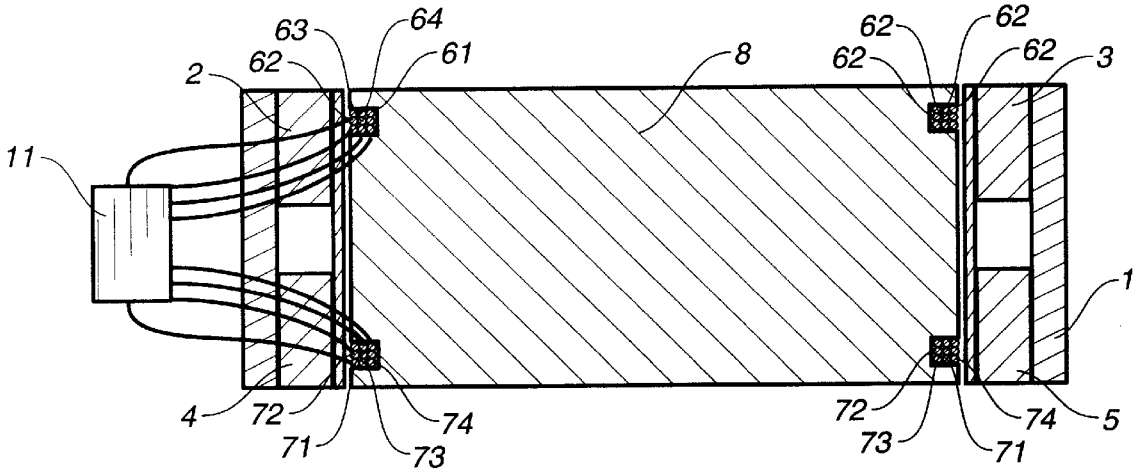
FIG. 11 shows a second mode of electrical connection of the apparatus which is the object of the present invention to a digital electronic circuit.

In FIG. 11 is shown a second mode of electrical connection of the apparatus which is the object of the present invention to a digital electronic circuit.

In FIG. 11 are shown the same elements as in FIG. 1 with the exception of the conductive circuits 6 and 7. Circuit 6 comprises a plurality of coil assemblies 61, 62, 63, and 64, each of the coil assemblies being connected to one of the coil assemblies 71, 72, 73, and 74 composing the circuit 7 and to one of the binary outputs of a digital circuit 31. The assemblies 61 and 71 comprise the same number of turns of wire equal to one and are connected to the logic output of the lowest weight. The assemblies 62 and 72 comprise the same number of turns of wire equal to two and are connected to the logic output of double the weight of the lowest weight. The assemblies 63 and 73 comprise the same number of turns of wire equal to four and are connected to the logic output of half the weight of the greatest weight. Assemblies 64 and 74 comprise the same number of turns equal to eight and are connected to the logical output of the highest weight. In this way, the logical weights which are successively multiplied by two by two correspond to forces whose values are respectively multiplied two by two. The apparatus according to the invention in the embodiment shown in FIG. 11 can thus be connected directly to the digital output of a digital disc reader, a digital cassette reader, a digital radio, a digital sound synthesizer and more generally to any systems emitting signals representative of sound functioning with digital signals. It is important to note that to obtain forces which are multiples of one another two by two, the apparatus can also comprise various amplifiers or geometries positioning the coils in the magnetic fields of different intensities. To improve the results of the various embodiments of the invention shown in FIGS. 1–11, the following remarks should be made.

The diffusing volume 8 can be divided into various density of Young's modulus materials which are different to resolve the intermodulation distortion and the tone distortion.

The ratios of the surfaces and of the volumes of the diffusing volume 8 as well as the number of magnets and their arrangements can vary as a function of the qualities which are sought. By way of preferred example, the ratio of the thickness of the diffusing volume over its greatest dimension is greater than 10%.

A radiator enveloping the conductive circuits 6, 7, 12, 13, 20, 21 and 22 makes it possible to dissipate the heat generated over said conductive circuits. This radiator can be constituted, for example by a fine metallic sheet covering the conductive circuits as well as the lateral surfaces of the diffusing volume 8, in a manner such that the heat is evacuated in the air separating the diffusing volume 8, on the one hand, and in the permanent magnets, on the other hand.

The principle advantages of the present invention are:

a very high ease of industrial or artisanal manufacture;

an easy variation of the surfaces and volumes of the apparatuses achieved, by simple variation of the lengths of the permanent magnets and the dimensions of the diffusing volume 8.

A single path being sufficient to obtain a spectral response which is very wide and having a low directivity.

The apparatus can also be adapted to enclosures of small dimensions, to enclosures of large dimensions or further to listening devices generally referred to as headsets.

The present invention furthermore has the advantage of allowing for the easy manufacturing of diffusing sound panels of large dimensions.

Numerous other embodiments of the invention remain in conformance with the spirit of the invention as it appears from the annexed drawings, whatever the shape of the diffusing volume 8, spherical, ellipsoidal, cubical, for example, and the arrangement of the magnets and of the conductive circuits over the periphery of this diffusing volume 8.

I claim:

1. An electroacoustic transducer comprising:

a low density diffusing volume having a periphery, wherein the diffusing volume comprises an element and a membrane, wherein the element has a thickness which is relatively close to a width and a length of the diffusing volume, and wherein the membrane has a thickness less than a tenth of the thickness of the element;

a first electrically conductive circuit supported on and connected mechanically to an upper periphery of the low density diffusing volume, said first electrically conductive circuit being capable of carrying an electric signal representative of an audible signal to be emitted;

a second electrically conductive circuit supported on and connected mechanically to a lower periphery of the low density diffusing volume, the second electrically conductive circuit being capable of carrying an electrical signal representative of the audible signal to be emitted, the electrical signal of the second electrically conductive circuit being opposite to the electrical signal of the first electrically conductive circuit;

a first pair of magnets capable of providing a magnetic field whose field lines surround at least one of the first and second electrically conductive circuits, the first pair of magnets being positioned on the periphery of the low density diffusing volume, said first pair of magnets having common poles facing each other; and a second pair of magnets capable of providing a magnetic field whose field lines surround another of said first and second electrically conductive circuits, said second pair of magnets being positioned on the periphery of the low density diffusing volume, said second pair of magnets having common poles facing each other, said common poles facing each other, said common poles of said second pair of magnets being opposite said common poles of said first pair of magnets.

2. The transducer of claim 1, wherein the low density diffusing volume has a mass which is greater than 20 grams.

3. The transducer of claim 1, wherein the low density diffusing volume comprises a recess.

4. The transducer of claim 1, wherein the low density diffusing volume comprises grooves.

5. The transducer of claim 1, wherein the low density diffusing volume has a density of less than 0.20 kilograms per liter.

6. The transducer of claim 1, further comprising a support membrane mechanically connecting the at least two magnets and the low density diffusing volume.

7. The transducer of claim 1, further comprising an electronic amplifying circuit adapted to emit an electric signal representative of the audible signal to be emitted, the electronic amplifying circuit being connected to the first and second electrically conductive circuits, each of the at least one electrically conductive circuits being connected to a fixed potential, the electric signal emitted by the electronic amplifying circuit comprising a continuous component equal to an average of the fixed potentials and an alternating component representative of the audible signal to be emitted.

8. The transducer of claim 1, wherein each of the first and second electrically conductive circuit comprises coil assemblies connected to binary logic outputs of a digital electronic circuit.

9. The transducer of claim 1, wherein the low density diffusing volume is selected from the group consisting of expanded polystyrene and polyurethane foam.

10. An electroacoustic transducer, comprising:

a low density diffusing volume having a periphery, wherein the diffusing volume has a thickness which is relatively close to a width and a length of the diffusing volume;

a first electrically conductive circuit supported on and connected mechanically to a side of the low density diffusing volume, said first electrically conductive circuit being capable of carrying an electric signal representative of an audible signal to be emitted;

a second electrically conductive circuit supported on and connected mechanically to an opposite side of the low density diffusing volume, the second electrically conductive circuit being capable of carrying an electrical signal representative of the audible signal to be emitted, the electrical signal of the second electrically conductive circuit being opposite the electrical signal of the first electrically conductive circuit;

a first magnet capable of providing a magnetic field whose field lines surround the first electrically conductive circuit, the first magnet being positioned on a side of the low density diffusing volume, said first magnet having a pole facing said first electrically conductive circuit; and a second magnet capable of providing a magnetic field whose field lines surround said second electrically conductive circuits said second magnet being positioned on an opposite side of the low density diffusing volume, said second magnet having a pole facing said second electrically conductive circuit, said pole of said second magnet being opposite said pole of said first magnet.

11. The transducer of claim 10, wherein said first and second electrically conductive circuits are asymmetrical with respect to each other.

12. The transducer of claim 10, wherein the low density diffusing element has a mass which is greater than 20 grams.

13. The transducer of claim 10, wherein the low density diffusing element has a density of less than 0.20 kilograms per liter.

14. The transducer of claim 10, further comprising an electronic amplifying circuit adapted to emit an electric signal representative of the audible signal to be emitted, the electronic amplifying circuit being connected to the first and second electrically conductive circuits, each of the first and second electrically conductive circuits being connected to a fixed potential, the electric signal emitted by the electronic amplifying circuit comprising a continuous component equal to an average of the fixed potentials and an alternating component representative of the audible signal to be emitted.

15. The transducer of claim 10, wherein the low density diffusing element is selected from the group consisting of expanded polystyrene and polyurethane foam.

16. An electroacoustic transducer comprising:

a low density diffusing volume having a periphery, wherein the diffusing volume has a thickness which is relatively close to a width and a length of the diffusing volume;

a first electrically conductive circuit supported on and connected mechanically to a side of the low density diffusing volume, said first electrically conductive circuit being capable of carrying an electric signal representative of an audible signal to be emitted;

a second electrically conductive circuit supported on and connected mechanically to an opposite side of the low density diffusing volume, the second electrically conductive circuit being capable of carrying an electrical signal representative of the audible signal to be emitted, the electrical signal of the second electrically conductive circuit being opposite the electrical signal of the first electrically conductive circuit;

a first pair of magnets capable of providing a magnetic field whose field lines surround the first electrically conductive circuit, the first pair of magnets being positioned on said one side of the low density diffusing volume, said first pair of magnets having common poles facing each other; and a second pair of magnets capable of providing a magnetic field whose field lines surround the second electrically conductive circuits, said second pair of magnets being positioned on said opposite side of the low density diffusing volume, said second pair of magnets having common poles facing each other, said common poles of said second pair of magnets being opposite said common poles of said first pair of magnets.

* * * * *